United States Patent [19]

Meier

[11] 4,017,010

[45] Apr. 12, 1977

[54] CLOSURE ELEMENT FOR A SLIDE CLOSURE AND PROCESS FOR THE MANUFACTURE THEREOF

[75] Inventor: Ernst Meier, Kilchberg, Switzerland

[73] Assignee: Stopinc Aktiengesellschaft, Zug, Switzerland

[22] Filed: July 11, 1975

[21] Appl. No.: 595,307

[30] Foreign Application Priority Data

July 17, 1974 Switzerland ..... 9858/74

[52] U.S. Cl. ..... 222/590; 222/600; 264/30; 222/504;512;561;600;590

[51] Int. Cl.[2] ..... B22D 37/00

[58] Field of Search ..... 251/173, 193, 195; 266/280, 281; 264/30; 222/504, 512, 561, 222/590, 600

[56] References Cited

UNITED STATES PATENTS 3,765,579 10/1973 Cramer et al. ..... 222/561 X

FOREIGN PATENTS OR APPLICATIONS 907,922 3/1954 Germany ..... 264/30

*Primary Examiner*—Robert B. Reeves
*Assistant Examiner*—David A. Scherbel
*Attorney, Agent, or Firm*—Wenderoth, Lind & Ponack

[57] ABSTRACT

A refractory element of a slide closure includes a metal support element and a refractory plate mounted therein by a solidifiable refractory mass. The plate is first positioned at a desired location within the support element, without refractory mass, by an auxiliary device including spacers. The auxiliary device is then released, the plate is removed, and the refractory mass is added. The plate is then again added and placed in the previously determined location by the auxiliary device, and held thereat until the mass solidifies.

8 Claims, 12 Drawing Figures

FIG. 1
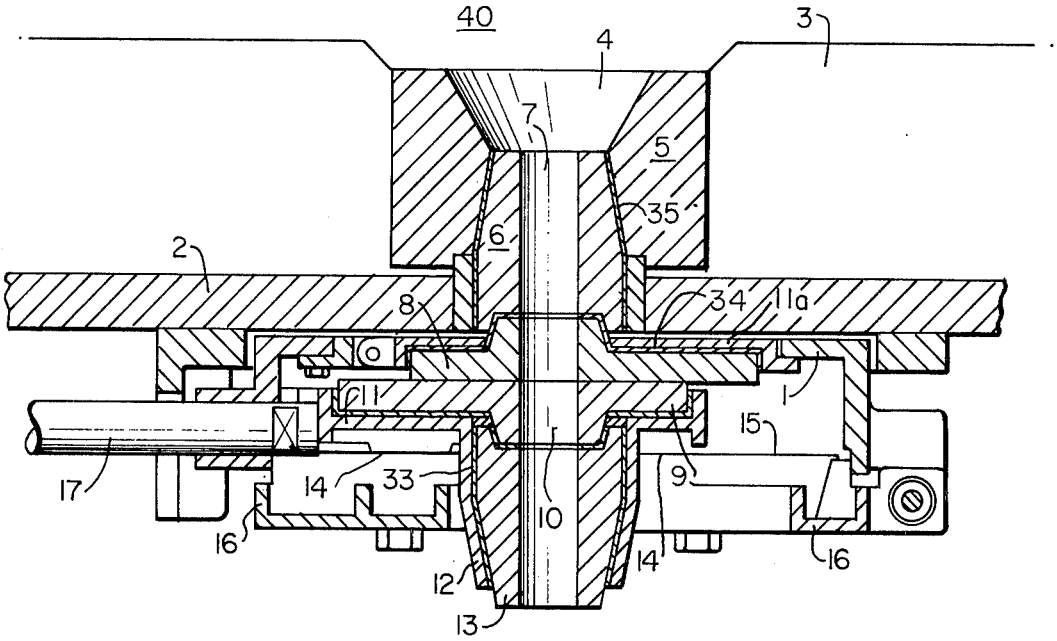
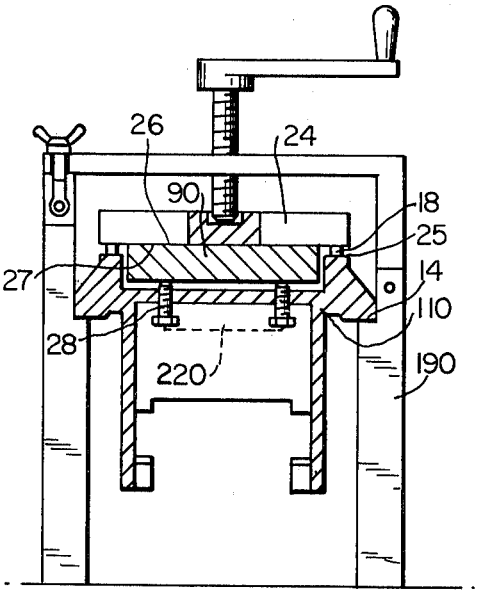
FIG. 2
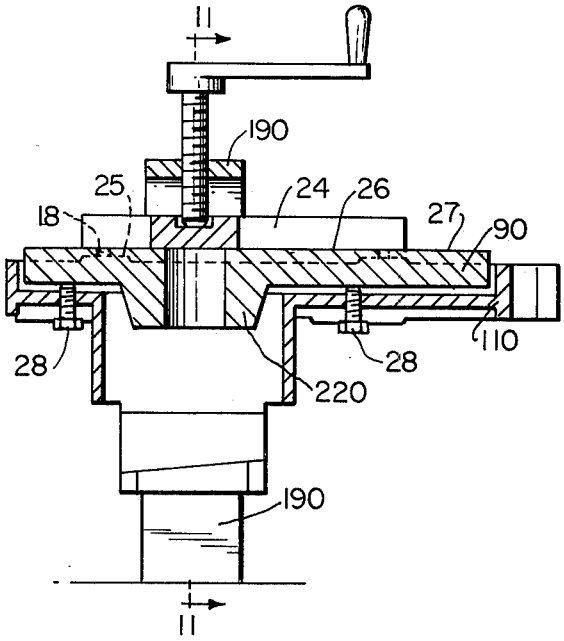
FIG. 3

CLOSURE ELEMENT FOR A SLIDE CLOSURE AND PROCESS FOR THE MANUFACTURE THEREOF

BACKGROUND OF THE INVENTION

The present invention relates to a closure element of a slide closure for liquid melt containers, e.g., steel ladles, which closure element consists of a metallic support element having bearing surfaces, and a refractory plate embedded in such support element by means of refractory material and having a sliding surface and a passage opening, as well as to a process for manufacturing such a closure element.

The closure element is preferably employed as a stationary apertured plate or as a movable slide plate of a slide closure for vessels containing melts at high temperatures.

It is known that the reliable operation of such a slide closure depends largely on the clean and precise fitting of the refractory parts, i.e. of the stationary apertured plate and the movable slide plate, of the vessel. In such closures it is of extreme importance that the two plates which form the closure proper always rest or slide on each other with full sealing contact during the opening and closing operations. Devices for achieving such full sealing contact have already been proposed. However, such devices have not proven entirely satisfactory for the following reasons.

While the slide plate glides or slides on the stationary apertured plate, the support element which contains the side plate has bearing surfaces which ride on stationary guide ribs or ridges of the closure cover. Accordingly, care must be take that the bearing surfaces of the support element and the sliding surface of the slide plate always be plane parallel to each other within very low tolerances, preferably smaller than 1/100 mm, if jamming of the slide is to be avoided. It is hardly possible or economical to manufacture every coupling and fitting surface of slide plate and support element with a precision that corresponds to such tolerances. Accordingly, the irregularities of manufacture were compensated in known slide closures by the provision of a motor bed or layer between the plate and the support element. The compensation thereby achieved is generally effective when provided by very skilled technicians and while making use of known auxiliary devices.

A known auxiliary device of this type is described in German printed specification DT-AS No. 1,301,446 and in German specification DT-OS No. 2,031,938. However, such device exhibits two disadvantages, particularly in the case of large slide closures. The proper mounting of the plate in the support element of the closure element depends on the consistency of mortar. If the mortar is too hard, the forces required for the plane parallel forcing of the plate into the mortar bed are too high. If the mortar is too soft, the plate will change its position in the mortar bed in an unforeseen and generally irregular manner under the effect of its own weight, after the mounting operation and prior to the hardening of mortar, which change of position is unacceptable. Furthermore, the immovable mounting of the plate is completed only after the full setting of the mortar, which setting takes time.

SUMMARY OF THE INVENTION

The object of the present invention is to guarantee and accelerate an operationally reliable and precise mounting of the plates in their support elements.

This is achieved in accordance with the present invention by the provision of a plurality of, preferably at least four, vertically adjustable spacers that are arranged between the support element and the plate.

Due to such an arrangement, it is possible in a simple and economic manner to position the sliding or gliding surface, e.g. of the slide plate, precisely plane parallel to the bering surfaces or the sliding path of the support element which supports the slide plate and to obtain in this manner an operation of the slide closure which is substantially free of jamming.

For the manufacture of such a closure element according to the invention, the plate is positioned in the support element and, prior to the solidification of the holding mortar, is positioned and held in a final operational position in an auxiliary device by means of vertically adjustable spacers.

For the achievement of the process of the invention, there is employed an auxiliary device which has two, three or four bases for supporting bearing surfaces of the support element, as well as a clamping member movable perpendicularly to the plane of the bases and having supporting surfaces that rest on reference surfaces of the support element that are associated therewith. The clamping member has an adjusting surface for adjusting the plate, which adjusting surface is parallel to the bases and is oriented toward the support element.

BRIEF DESCRIPTION OF THE DRAWINGS

The invention will be described in more detail below with reference to the accompanying drawings, wherein:

FIG. 1 is a longitudinal section through a slide closure attached to a metallurgical vessel, the spacers are not being shown in this figure for clarity of illustration of the overall environment of the present invention;

FIG. 2 is a sectional elevation of an auxiliary device for mounting a slide plate in a determined position, taken along lines II—II of FIG. 3;

FIG. 3 is a longitudinal section through the device of FIG. 2;

DETAILED DESCRIPTION OF THE INVENTION

Figure 5:
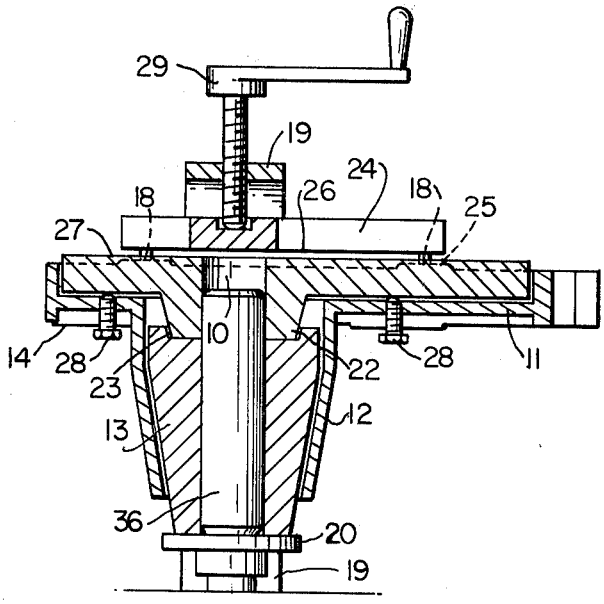
FIG. 5 is a longitudinal section through the device of FIG. 4, prior to the final positioning thereof.

A metal slide housing 1 is firmly attached to a metal jacket 2 of a vessel 40 for liquid melts, e.g. a steel ladle or a tundish, at a position below an outlet opening 4 of a bottom brick 5 which is inserted into refractory brickwork 3 of vessel 40. A brick spout 6 extends into bottom brick 5 and is provided with a duct 7, in communication with opening 4. A stationary upper refractory apertured plate 8 is positioned within slide housing 1 below bottom brick 5, in a cassette 11*a* employed as support element for apertured plate 8. Apertured plate 8 and cassette 11*a* form the stationary closure element of the slide closure. A refractory slide plate 9, engaging apertured plate 8 and provided with a passage opening 10, is mounted in a metal displaceable support element 11 which together form the movable closure element of the slide closure. The lower portion of the support element 11 forms a spout 12, in which is positioned a refractory outlet sleeve 13. Support element 11 is provided on the lower side of the upper portion thereof with bearing surfaces 14 which slide on corresponding ridges or ribs 15 of a closing cover 16. Support element 11, with slide plate 9 and outlet sleeve 13 carried thereby is displaced by an electric, hydraulic or similar drive device (not shown) which engages an operating rod 17 that is detachably coupled to support element 11.

Refractory parts 6, 8, 9 and 13 come into direct contact with the liquid melt, thereby being subjected to wear, and must be very frequently replaced, some parts even after every pouring operation. The parts subjected to wear are embedded in their respective supported positions by means such as mortar 33, 34 and 35.

Figure 6:
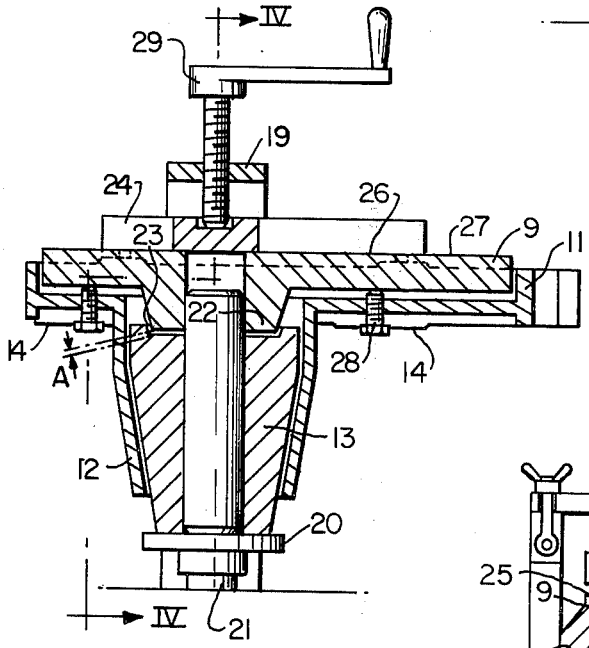
FIG. 6 is a longitudinal section similar to FIG. 5, but after final positioning.
Figure 4:
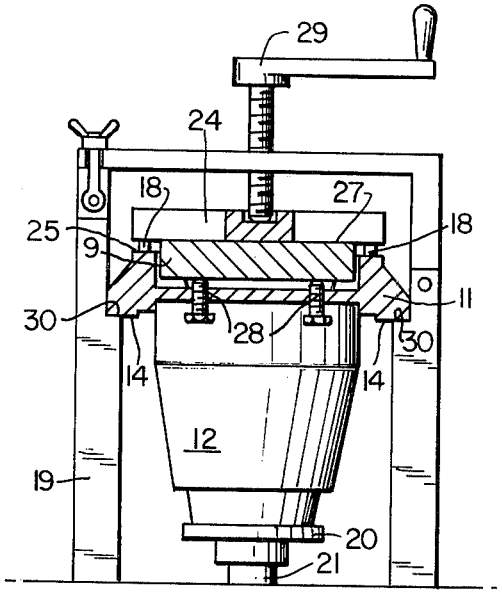
FIG. 4 is a sectional elevation of a modified auxiliary device for mounting a slide plate in a determined position, taken along lines IV—IV of FIG. 6.
Figure 7:
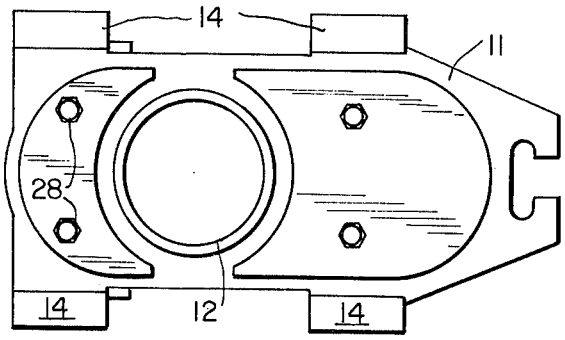
FIG. 7 is a bottom view of a support element.
Figure 8:
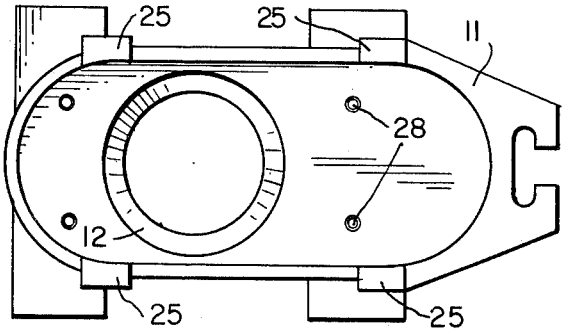
FIG. 8 is a top view of the support element of FIG. 7.
Figure 9:
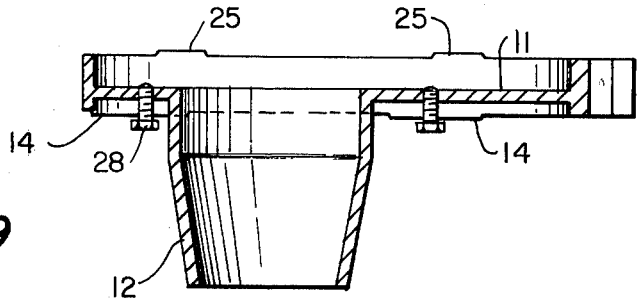
FIG. 9 is a longitudinal section through the support element of FIGS. 7 and 8.

FIGS. 4 to 6 illustrate one embodiment of the invention of the manner of mounting the movable closure element of FIG. 1, i.e. slide plate 9, outlet sleeve 13, and support element 11, which is shown in FIGS. 7 to 9. In the various figures similar parts are illustrated by similar reference numerals. The following is the procedure for mounting slide plate 9 and outlet sleeve 13 in support element 11.

Support element 11 is placed with its bearing surfaces 14 on bases 30 of a frame or table 19, and outlet sleeve 13 as well as slide plate 9 are placed dry (i.e. without mortar) into the support element 11, as shown in FIG. 4. Outlet sleeve 13 then rests on a plate 20, which is vertically adjustable by means of a spindle 21, while downward proturberance 22 of slide plate 9 extends into a groove or recess 23 of outlet sleeve 13, as shown in FIG. 5.

A known pressure applying cross-shaped element 24 is then placed on support element 11. Element 24 has four arms with four supporting surfaces 18 that are positioned in the same plane and rest on four reference surfaces 25 of support element 11. A horizontal adjusting surface 26 of element 24 and the four supporting surfaces 18 thereof, on the one hand, and reference surfaces 25 of support element 11 and lower bearing surfaces 14 thereof, on the other hand, are each positioned in planes parallel to each other.

Since plate 20 is initially set at such a level that sleeve 13 is not positioned within spout 12 with play therebetween for the receipt of mortar or other embedding material, refractory parts 9 and 13 are lifted with respect to support element 11 by means of adjustable plate 20 until the width of a gap between adjusting surface 26 and a gliding surface 27 of slide plate 9 amounts to about 2 mm, as shown in FIG. 5. Slide plate 9 is then lifted by means of four setscrews 28 until its gliding surface 27 fully contacts adjusting surface 26 of element 24. This produces a gap a between slide plate 9 and outlet sleeve 13, gap A having a width which is considered to be optimal for the particular elements that are exposed to the metal melt during operation of the slide closure.

The above operations, refractory elements 9 and 13 as well as support element 11 are situated in the relative positions shown in FIGS. 4 and 6, i.e. in the desired position required for the mortaring operation. Most importantly, gliding surface 27 of slide plate 9 is parallel within very narrow tolerances to bearing surfaces 14 of support element 11.

The positions of support element 11, slide plate 9 and outlet sleeve 13 obtained by the above operations are now reproducible by means of the settings of spindle 21 and spacing setscrews 28. Spindle 21 is secured against displacement. After a press or jack 29 is removed or released, element 24 can be lifted, so that slide plate 9 and outlet sleeve 13 can be removed. During the mounting and mortaring operation, the element 24 must again be pressed downward by the press 19 until supporting surfaces 18 contact reference surfaces 25, such that slide plate 9 again assumes its predetermined position in support element 11.

The mortar embedding operation now takes place in such a manner that both refractory parts 9 and 13 removed from the arrangement are provided with mortar and are then again inserted into support element 11. The mortar is first introduced into the gap between outlet sleeve 13 and spout 12, then into the gap between groove 23 and protuberance 22 and between the slide plate 9 and the support element 11. Pressure applying cross-shaped element 24 is then placed on slide plate 9 and is pressed downwardly by means of press 29, while any excess mortar is driven out, until the four supporting surfaces 18 of the element 24 again contact the four reference surfaces 25 of support element 11.

It is of essential importance in accordance with the invention that the four setscrews 28 reliably prevent any sinking or shifting of slide plate 9 with respect to support element 11 prior to the final setting of the originally soft, plastic mortar.

FIGS. 2 and 3 illustrate a modified embodiment of the invention. The spout of a support element 110 is omitted, or at least shortened, and thus the refractory sleeve is also omitted, and is replaced by a protuberance 220 of a slide plate 90. A plate, such as plate 20 of FIGS. 4 through 6, of an auxiliary device 190 is no longer required for mounting refractory plate 90 and support element 110. In a first step, setscrews 28 are lowered such that adjusting surface 26 and gliding surface 27 are no longer in contact. Thus, supporting surfaces 18 of element 24 rest on reference surfaces 25. Then plate 90 is again lited by setscrews 28 until gliding surface 27 contacts surface 26 of element 24. The remaining steps or operations correspond to those of the procedure described above with reference to FIGS. 4 through 6.

The primary object of the described mounting operation is the guaranteed plane-parallel position of gliding surface 27 in relation to bearing surfaces 14 of support elements 11 or 110. A cylinder 36 may be employed as a centering means for slide plate 9 or 90 and sleeve 13, the cylinder 36 fitting opening 10 in plate 9 or 90.

In order to reliably attain the above primary object, the ends of setscrews 28 are provided with a tip that is only slightly rounded. This prevents the sticking of mortar between such ends and the lower side of slide plate 9 or 90, which would exert a detrimental effect on ability to achieve the desired fine adjustment. The small member of setscrews of this type may not and should not be used for the absorption of the considerable pressures produced through the prestressing or pretensioning of the plates. This function still should be performed by the layer of mortar.

The number of the setscrews is not of critical importance. Even two or three would be sufficient, and a number larger than four would likewise be satisfactory.

Figure 10A:
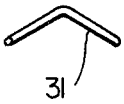
FIGS. 10*a* and 10*b* are respectively enlarged frontal elevation and top views of a spacer usable in accordance with the invention.
Figure 10B:
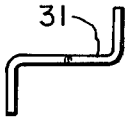

In place of the setscrews 28, it is possible to use other spacer elements that are capable of performing the same desired function. For example, it is possible to use permanently compressible metal parts, e.g. spacers 31 shown in FIG. 10 and consisting of annealed copper or light metal wire. In such case the height of the spacer is not changed from the outside by means of screws. Rather, such height change is effected through compression of the spacers performed by the element 24. This method is particularly inexpensive, while the use of the setscrews achieves a somewhat more precise final result.

Figure 11:
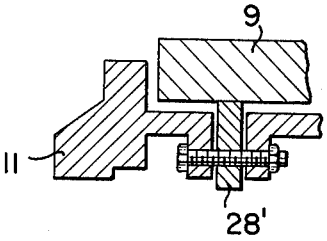
FIG. 11 is a partial section illustrating the use of a rotatable eccentric as a spacer element in place of a setscrew.

Rotatable eccentrics, e.g. as shown at 28' in FIG. 11, may be used in place of the setscrews.

The invention has been described with regard to the movable closure element consisting of slide plate 9 or 90 and support element 11 or 110. Of course, the concept of the invention is also valid for the stationary closure element, consisting of apertured plate 8 and cassette 11*a*, of a slide closure. The importance of the invention resides in the embedding of the refractory plates, which slide with respect to each other, in the respective support elements to provide a precise positioning of the gliding surfaces.

What is claimed is:

1. In a closure element of a slide closure for use in liquid melt containers, e.g. steel ladles, said closure element including a metallic support element having bearing surfaces in a first plane and a refractory plate embedded within said support element by means of refractory mortar material and having a first surface embedded in said motar material, a second, sliding surface and a passage opening, the improvement comprising:

a plurality of adjustable spacer means adjustable perpendicularly to said first plane and positioned between said support element and said first surface of said plate for selectively adjusting the spacing and positioning therebetween and for aligning said sliding surface of said plate in a second plane parallel with said first plane.

2. The improvement claimed in claim 1, wherein said spacer means are enclosed in an embedding material positioned between said support element and said plate.

3. The improvement claimed in claim 1, wherein said spacer means comprise setscrews extending through said support element toward said plate, each said setscrew having a head positioned without said support element.

4. The improvement claimed in claim 3, wherein each said setscrew has a rounded tip.

5. The improvement claimed in claim 1, wherein said spacer means comprise eccentrics positioned in said support element.

6. The improvement claimed in claim 1, wherein said spacer means comprise elastically deformable, bent wire elements inserted into said support element.

7. A process for assembling a closure element of a slide closure for use in liquid melt containers, e.g. steel ladles, said closure element including a metallic support element having bearing surfaces located in a first plane and a refractory plate embedded within said support element by means of a plastic, solidifiable refractory mass and having a first surface embedded in said refractory mass and a second, sliding surface, such that said sliding surface of said plate extends in a second plane parallel to said first plane of said bearing surfaces of said support element, said method comprising:

inserting said plate within said support element; and prior to solidification of plastic, solidifiable refractory mass material positioned therebetween, positioning and holding said plate in a desired final operational position within an auxiliary device by means of providing adjustable spacers adjustable perpendicularly to said first plane and positioned between said support element and said first surface of said plate, and adjusting said spacers until said sliding surface of said plate is positioned within a second plane parallel to said first plane.

8. A process as claimed in claim 7, further comprising positioning said plate at said desired operational position within said support element by means of said spacers, while maintaining a free space therebetween to be occupied by said refractory mass; thereafter releasing said auxiliary device and removing said plate; thereafter introducing said refractory mass; and again positioning said plate in said desired operational position by means of said spacers until said mass solidifies at least in part.

* * * * *